US011401008B2

(12) United States Patent
Cooper

(10) Patent No.: US 11,401,008 B2
(45) Date of Patent: Aug. 2, 2022

(54) INFLATABLE WATERCRAFT

(71) Applicant: BOTE, LLC, Fort Walton Beach, FL (US)

(72) Inventor: Corey Cooper, Fort Walton Beach, FL (US)

(73) Assignee: BOTE, LLC, Fort Walton Beach, FL (US)

( * ) Notice: Subject to any disclaimer, the term of this patent is extended or adjusted under 35 U.S.C. 154(b) by 113 days.

(21) Appl. No.: 16/919,479

(22) Filed: Jul. 2, 2020

(65) Prior Publication Data

US 2021/0001955 A1 Jan. 7, 2021

Related U.S. Application Data

(60) Provisional application No. 62/870,338, filed on Jul. 3, 2019.

(51) Int. Cl.

| | |
|---|---|
| ***B63B 7/08*** | (2020.01) |
| ***B63B 34/22*** | (2020.01) |
| ***B63B 25/00*** | (2006.01) |

(52) U.S. Cl.

CPC ..... *B63B 7/08* (2013.01); *B63B 7/082* (2013.01); *B63B 7/085* (2013.01); *B63B 25/00* (2013.01); *B63B 34/22* (2020.02)

(58) Field of Classification Search

CPC ..... B63B 7/06; B63B 2007/065; B63B 7/08; B63B 7/082; B63B 7/085; B63B 25/00; B63B 34/22

See application file for complete search history.

(56) References Cited

U.S. PATENT DOCUMENTS 1,631,047 A * 5/1927 Meyer ..... B63B 7/082 114/345
2,999,253 A * 9/1961 Lewis ..... B63B 34/22 114/347
4,063,320 A 12/1977 Neumann et al.
(Continued)

FOREIGN PATENT DOCUMENTS

CN 205 854 428 U 1/2017
DE 9110189 U1 * 10/1991 ..... B63B 7/08
(Continued)

OTHER PUBLICATIONS

Extened European Search Report issued relative to European patent application EP 20184088, dated Dec. 7, 2020.

*Primary Examiner* — Ajay Vasudeva
(74) *Attorney, Agent, or Firm* — Smith, Gambrell & Russell, LLP

(57) ABSTRACT

The present invention provides inflatable watercraft that are light weight, easily stowed in relatively small spaces and formed from inflatable drop stitch panels. A preferred watercraft is a boat having a bow, stern, keel and an open transom for self-bailing. A deck can be provided as a separate panel that is either permanently, or detachably, connected to freeboard sides of the watercraft. When connected, the deck provides a sitting area, and enhances the strength and rigidity of the watercraft by functioning like a deck beam. Optional features include a bucket held in place by, and fitted through, a hole in the deck panel. Preferred inflation pressures are between 2 and 25 p.s.i., and more preferably between 12 and 18 p.s.i.

20 Claims, 12 Drawing Sheets

(56) References Cited

U.S. PATENT DOCUMENTS

| | | | | | |
|---|---|---|---|---|---|
| 4,919,631 | A * | 4/1990 | Stafford | B63C 11/202 | 114/315 |
| 5,546,885 | A * | 8/1996 | Porada | B63B 7/085 | 114/345 |
| 6,065,421 | A * | 5/2000 | Haller | B63B 34/22 | 114/347 |
| D505,653 | S * | 5/2005 | Watling | B63B 11/04 | D12/316 |
| 7,000,562 | B2 * | 2/2006 | Bouquard | B63B 7/082 | 114/345 |
| 9,038,562 | B2 * | 5/2015 | Cassanas | B63B 11/04 | 114/345 |
| 2007/0051293 | A1 * | 3/2007 | Austin | B63C 9/02 | 114/345 |
| 2015/0314832 | A1 | 11/2015 | Walker | | |

FOREIGN PATENT DOCUMENTS

| | | | | | |
|---|---|---|---|---|---|
| FR | 2 318 780 | | 2/1977 | | |
| GB | 884520 | A * | 12/1961 | B63B 7/085 | |
| JP | 2003312584 | A * | 11/2003 | B63B 32/51 | |
| WO | 2019/123347 | A1 | 6/2019 | | |

* cited by examiner

INFLATABLE WATERCRAFT

BACKGROUND OF THE INVENTION

1. Field of the Invention

The present invention relates to products made from drop stitch material that can be inflated for use, and easily stowed and stored when not in use. Inflatable watercraft made of drop stitch material can be carried without the need for vehicles or special handling racks. Watercraft for carrying one or two persons are formed from near net shape panels and provide a relatively simple construction, and provides a multi-functional platform for the user to enjoy a variety of aquatic sports and recreation. A deck panel can be permanently affixed the basic hull structure, or detachably connected to allow an optional open seating or standing area within the hull of the watercraft.

2. Description of the Related Art

In my application Ser. No. 15/904,999, filed Feb. 26, 2018, which is hereby incorporated by reference, I describe the use of drop stitch material used to make boats and the like. Drop stitch material has unique property mainly related to strength, which allows for inflation to higher levels of pressure. The yarns of essentially equal length, which extend between inner surfaces of the material, prevent uneven bulging. When fully inflated, the drop stitch materials creates slabs on the order of a couple inches in thickness which are strong and hard to the point of being comparable to solid plastic or wooden structures. These slabs can be shaped and combined to create unique structures, such as the boats described in my prior application.

My prior application describes inflatable drop stitch material used in making stand up paddle boards, known as "SUPs." When inflated, my inventive inflatable SUPs have the appearance, in terms of size and shape, and strength of SUPs made of solid material yet have the advantage of being lighter and compact, when deflated, to allow easy storage and stowage. With an inflatable SUP, a user can easily carry the deflated watercraft in a back pack.

While stand up watercraft such as an SUP provide both recreation and exercise, particularly for muscle groups in the back, stomach, shoulders and arms, a need exists for inflatable watercraft that are designed for users to sit while paddling, similar to kayaks, canoes, row boats and the like.

SUMMARY OF THE INVENTION

The present invention provides improved inflatable watercraft which can be easily stowed and stored in relatively small spaces, but when inflated, adopt the size, shape, and strength of a solid construction, one or two person kayak, paddleboard, canoe or similar watercraft.

In one embodiment, an inflatable watercraft includes a bottom panel having a fore end and an aft end, a port side and a starboard side, a bow end and a stern end, a port side freeboard panel having a bow end and a stern end, and being connected to the port side of the bottom panel, and a starboard side freeboard panel having a bow end and a stern end, and being connected to the starboard side of the bottom panel. The port side freeboard panel and the starboard freeboard panel converge at their respective bow ends, and terminate substantially parallel to each other at their stern ends to define an open transom. A deck panel is fixedly connected to and extends between the port side freeboard panel and the starboard side freeboard panel, such that the deck panel, the bottom panel, the port side panel and the starboard side panel define a bow and a stern, and an approximately midships seating area.

Preferably, the starboard side freeboard panel and the port side freeboard panel are permanently affixed to the bottom panel by connection means selected from the group consisting of adhesives, stitching and a combination of adhesives and stitching.

The open transom extends in height from an upper surface of the bottom panel to a lower surface of the deck panel, and in width from an inner surface of the port side freeboard panel to an inner surface of the starboard side freeboard panel, whereby water entering the watercraft drains by gravity out through the open transom.

Means are provided to supplement the connection between abutting panels by overlying an interface between two abutting panels. The preferred means are fabric panels, preferably made of PVC, which, when used provide streamlining of outer surfaces and strengthening of interconnections between adjacent panels.

Optionally, the watercraft can be provided with means for holding items to an upper surface of the deck panel. The preferred means for holding include an elastic cord arranged in a zig-zag pattern between a plurality of O-rings adhered to the upper surface of the deck panel, although other patterns can be used, and rings of other shapes and other fasteners can be used.

The bottom panel, the starboard side freeboard panel, the port side freeboard panel, and the deck panel are each made of inflatable drop stitch material, each provided with a separate inflation valve to allow inflation between 2 and 25 p.s.i. Preferably a high pressure material is used that permits inflation pressures to between 7 and 25 p.s.i., and more preferably an inflation pressure range of between 12 and 18 p.s.i is used, with a recommended pressure of 15 p.s.i. The bottom panel, the starboard side freeboard panel, the port side freeboard panel, and the deck panel are each airtight inflatable chambers having an inflation value, but alternatively, if the chambers are in fluid communication with each other, a single inflation valve, or a number less than the number of panels, can be used.

Preferably, the deck panel includes an opening, and the inflatable watercraft further includes a bucket fitting in the opening. The opening is sized to fit a circular, five gallon bucket that can be used to hold bait, or when not used for bait, for holding beverages, food, and ice. The bucket could also be used as a water tight container for electrics, clothing, etc.

The inflatable watercraft preferably includes a plate disposed at the bow and connected between the starboard side freeboard panel and the port side freeboard panel, and extends from a gunwale of the bow to at least the waterline of the watercraft. More preferably, the plate is made of light weight, rigid plastic material to which ends of the respective freeboard panels are affixed, and the plate extends from the gunwale down to the waterline, and rearwardly at least partially along the centerline of a keel to contribute to both directional stability and to avoid damage to the keel when maneuvering over rocks or other solid objects.

In another embodiment, an inflatable watercraft includes a bottom panel having a fore end and an aft end, a port side and a starboard side, a bow end and a stern end, a port side freeboard panel having a bow end and a stern end, and being connected to the port side of the bottom panel, and a starboard side freeboard panel having a bow end and a stern end, and being connected to the starboard side of the bottom panel. The port side freeboard panel and the starboard freeboard panel converge at their respective bow ends, and terminating substantially parallel to each other at their stern ends to define an open transom, wherein the bottom panel, the port side panel and the starboard side panel define a bow and a stern.

Preferably the inflatable watercraft further includes a deck panel detachably connected to and extending between the port side freeboard panel and the starboard side freeboard panel, the deck panel including a seating area approximately at midships of the watercraft. As with the previously described embodiment, the deck panel includes an opening sized and positioned to hold a container which rests on an upper surface of the bottom panel and extends through the deck panel, held in position by the deck plate opening.

DETAILED DESCRIPTION OF THE INVENTION

Figure 1:
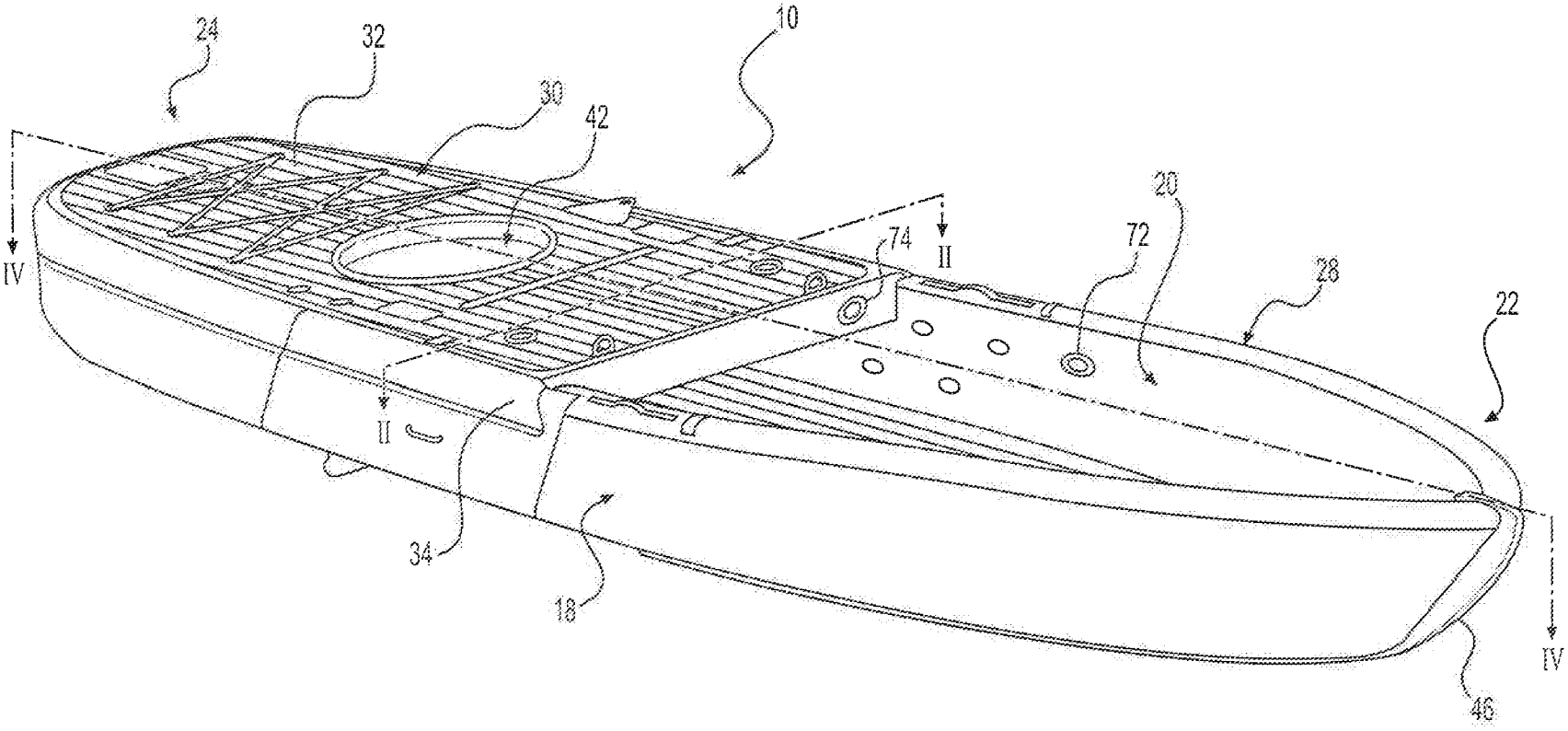
FIG. 1 is an exemplary side elevation view of a preferred embodiment of an inflatable watercraft according to the present invention.

The present invention provides improved light weight inflatable watercraft that can provide multi-functional aquatic platforms for fishing, sun bathing, locomotion, or in general exercise and entertainment. Structures described below are preferably made of inflatable drop-stitch fabric of the generally well known variety. Drop stitch panels typically are comprised of opposite sheets of material that are interconnected by threads bonded to the inner, opposed surfaces of the sheets of material. When inflated to pressures of, typically between 3 and 20 pounds per square inch (p.s.i.), the inflatable panels adopt a shape and strength comparable to solid structures, such as solid plastic, metal, or wooden boards. Advantageously, with drop-stitch fabric and panels, a deflated watercraft can be stowed and stored in a relatively small space, and transported to an appropriate aquatic venue without need for special carrying structures, such as luggage racks, or for that matter, vehicles of any kind. A user can place the deflated watercraft in a backpack and travel to the venue on foot or on bicycles, scooters (both electric and self-propelled) or the like.

Referring to FIGS. 1-7, an inflatable watercraft 10 includes a bottom panel 12 having a fore end 14 and an aft end 16, a port side and a starboard side, a bow end and a stern end. A starboard side freeboard panel 18 has a bow end and a stern end, and is connected to the starboard side of the bottom panel 12, by any known connection means, such as adhesive, stitching or a combination thereof, to permanently affix the starboard side freeboard panel 18 to the bottom panel 12 at a substantially right angle thereto and along mutual longitudinal edges.

A port side freeboard panel 20 has a bow end and a stern end, and is connected to the port side of the bottom panel 12 and, like the starboard side freeboard panel 18, is connected by any known connection means, such as adhesive, stitching or a combination thereof, to permanently affix the port side freeboard panel 20 to the bottom panel 12 at a substantially right angle thereto and along mutual longitudinal edges.

Figure 4:
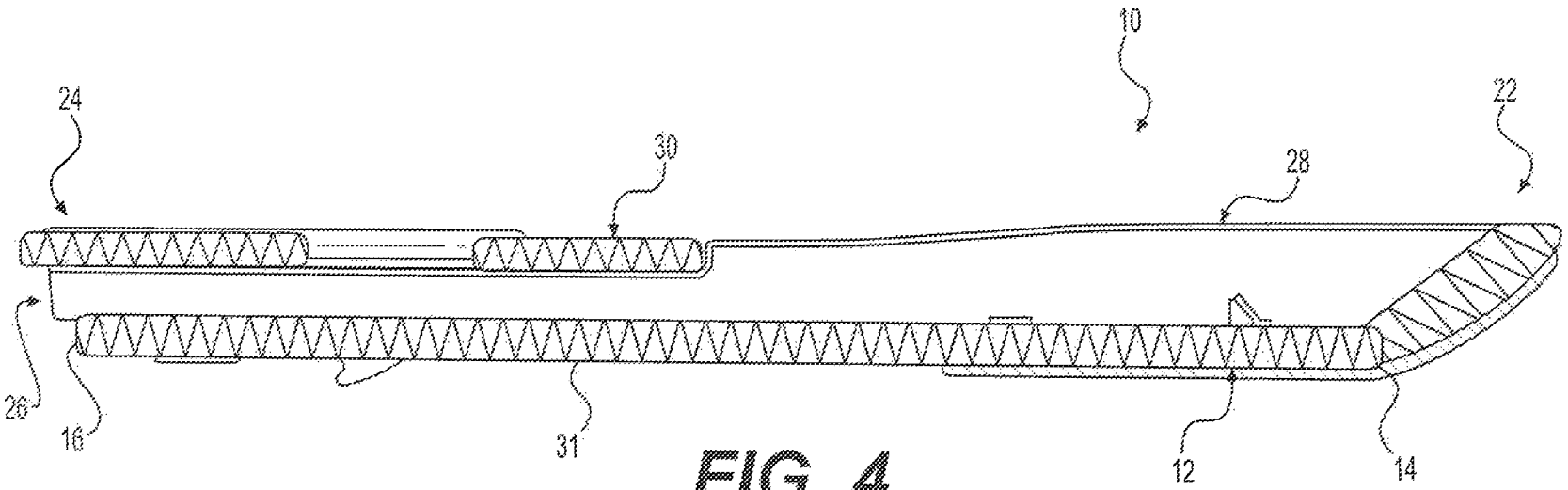
FIG. 4 is a longitudinal, sectional view taken along line IV-IV of FIG. 1.
Figure 5:
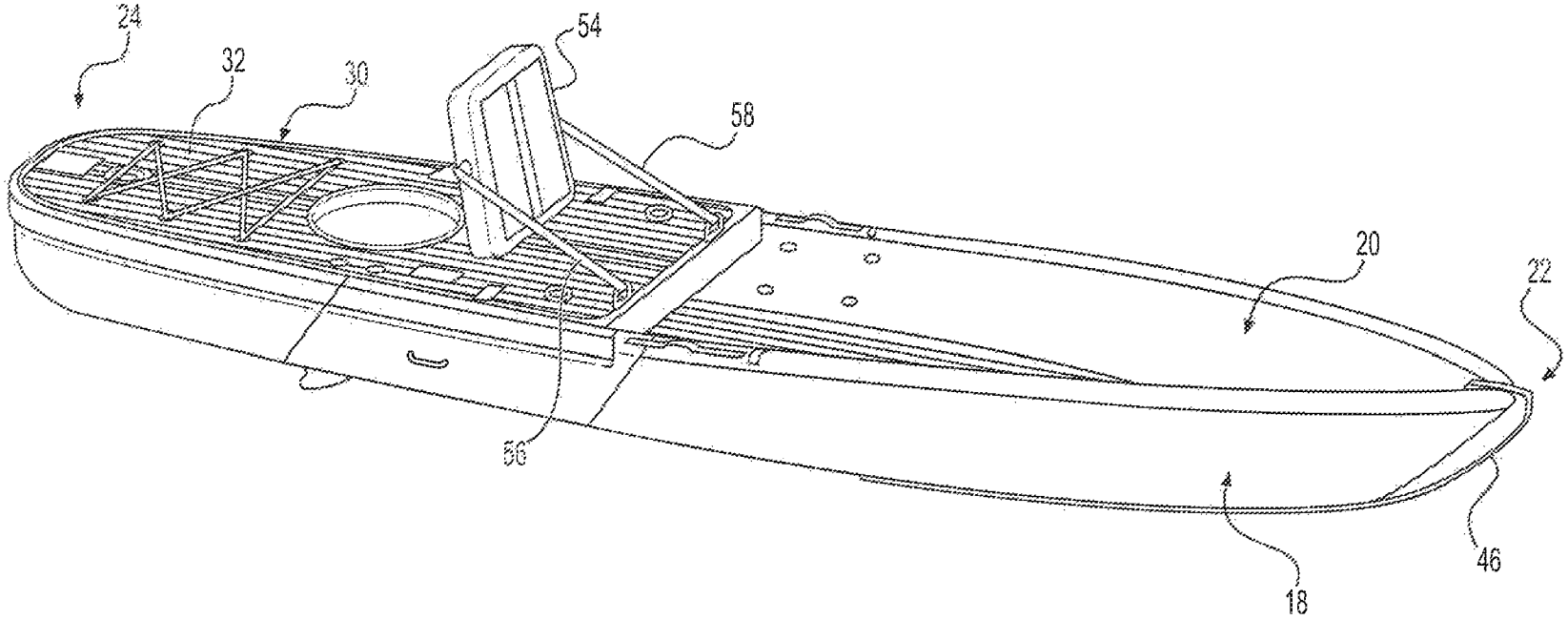
FIG. 5 is a side elevation view of the inflatable watercraft of FIG. 1, with an optional, detachable seat back.
Figure 6:
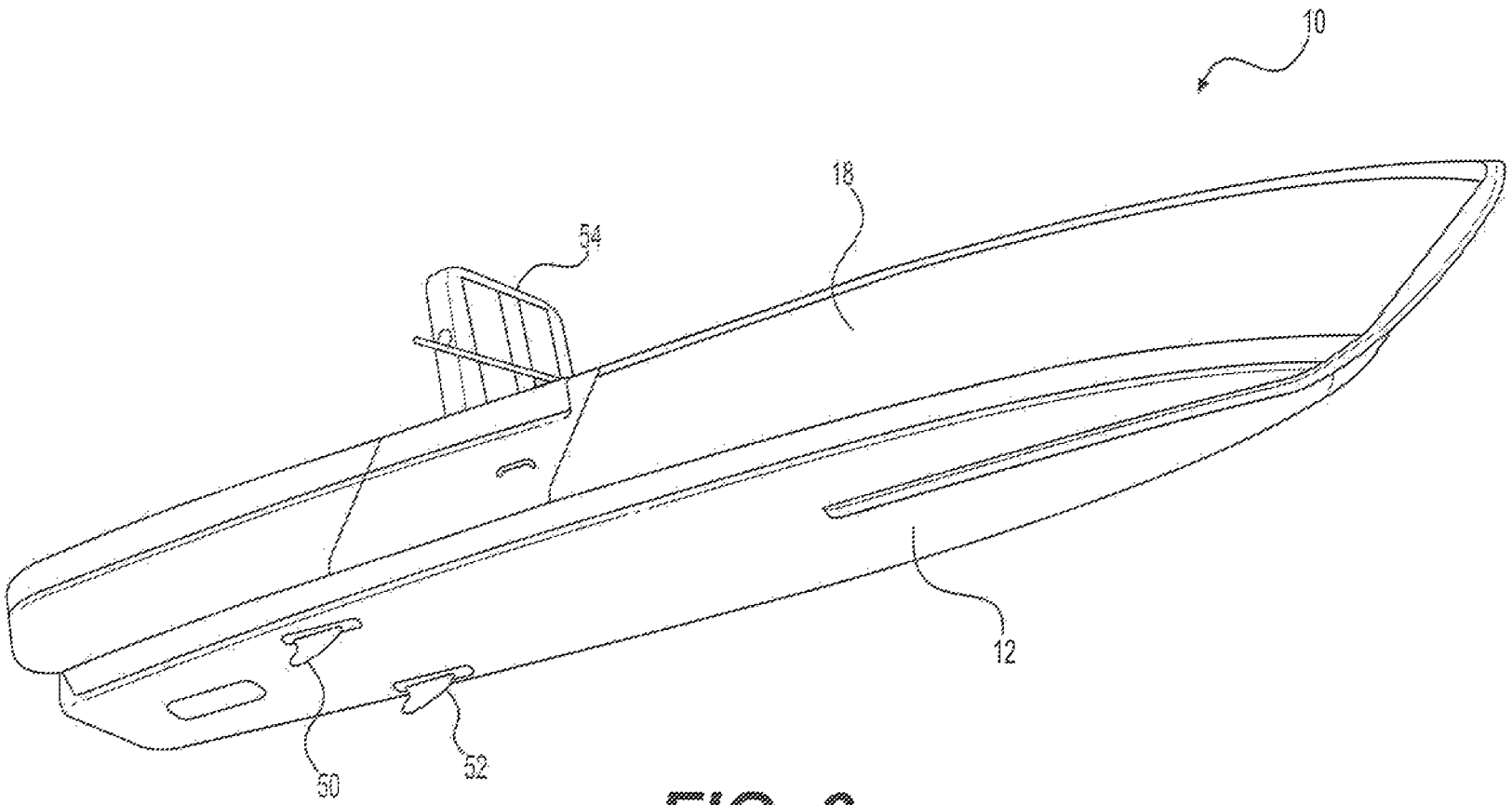
FIG. 6 is a bottom side elevation view of the inflatable watercraft of FIG. 4, showing the optional seat back on the upper surface of the deck panel, and skegs on the bottom surface of the bottom panel.
Figure 7:
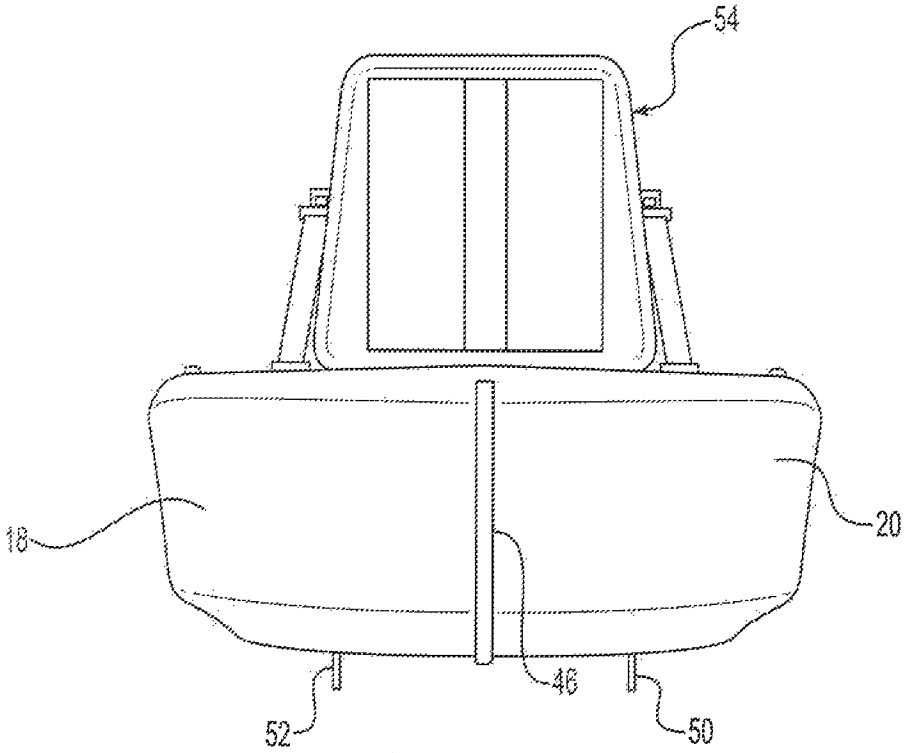
FIG. 7 is a front view of the inflatable watercraft of FIG. 4, again showing the optional seat back and underside skegs, as well as an optional bow plate where the two side panels come together.

The starboard side freeboard panel 18 and the port side freeboard panel 20 converge at their respective bow ends, and with a forward portion of the bottom panel 12 form a bow 22. The starboard side freeboard panel 18 and port side freeboard panel 20 terminate substantially parallel to each other at their stern ends, and with a rearward end of the bottom panel 12 define a stern 24 with an open transom 26 (FIG. 4). The open transom extends in height from an upper surface of the bottom panel 12 to an upper extent of the starboard side freeboard panel 18 and the port side freeboard panel 20, and in width from an inner surface of the starboard side freeboard panel 18 to an inner surface of the port side freeboard panel 20. Water entering the watercraft, coming in over the freeboard panels on the sides or over the bow and stern, on the ends, drains by gravity out through the open transom 26. The open transom 26 thus provides a self-bailing structure, in part made possible by the upper surface of the bottom panel 12 being above the waterline of the watercraft and substantially level when a user is located approximately midships. Shifting the user's position aft can cause water to drain from a fore direction aft towards the open transom 26.

As seen in FIG. 1, an upper edge of the starboard side freeboard panel 18 and the port side freeboard panel 20 define a gunwale 28. A deck panel 30 is fixedly connected to and extends between the starboard side freeboard panel 18 and the port side freeboard panel 20, such that the deck panel 30, the bottom panel 12, the port side freeboard panel 20 and the starboard side freeboard panel 18 define the bow 22, the stern 24 and a substantially flat keel 31. A user would sit approximately midships on the upper surface 32 of the deck panel 30. When sitting, the user's legs would extend into the open forward space between the bow 22 and the forward edge of the deck panel 30. Like the freeboard panels, the deck panel 30 can be permanently affixed to the using any conventional connecting means including adhesives, stitching or a combination of adhesives and stitching.

Fabric strips 34, 36, and 38 can be used to supplement the connection between the panels where abutting surfaces are joined. The strips also provide a more streamlined outer appearance and thus strengthen the interconnections between the panels and also provide smoother and less wetted surface area for better hydrodynamics. The fabric strips can overlie areas of adhesive bonding and stitching and strengthen the overall connection and protect the stitching and/or adhesive bonding. Polymer coatings can be applied over the fabric strips to assist in adhering the strips to the panels. The fabric strips can be PVC fabric strips that overlap interfaces between two panels.

The deck panel 30 preferably includes means for holding objects to its upper surface 32. One particularly preferred holding means includes an elastic cord 40, e.g., a length of "bungie" cord, that zig-zags between O-rings adhered to the upper surface 32 in parallel rows. Articles of clothing, water tight containers for holding wallets, phones, maps, GPS devices, etc., can be placed between the cord 40 and the upper surface 32 and held fast thereto by tension in the cord 40.

The deck panel 30 may include a circular opening 42 sized to fit a bucket 44 which can rest on the upper surface of the bottom panel 12, yet be stabilized by fitting within the hole 42. The bucket can be used for multiple purposes, and multiple buckets could be provided as well. In one preferred use, the bucket can be used to hold fish if the watercraft 10 is used as a fishing platform. The bucket 44 could also be used to hold camping equipment, clothing cameras, phones, wallets, etc., and made airtight by fitting a lid over the open top of the bucket 44. The bucket 44 can be a standard five gallon bucket of the size and shape used to hold paints.

A solid, bow plate 46 can be used to strengthen the bow 22 from collisions, or in general, simply to add structural rigidity to the watercraft. The plate can be made of light weight, rigid plastic material to which ends of the respective freeboard panels can be affixed. The bow plate 46 can also extend from the gunwale 28 down to the waterline, and then rearwardly at least partially along the centerline of the keel to contribute to both directional stability and to avoid damage to the keel when maneuvering over rocks or other solid objects.

Optionally, a mesh net 48 can be provide under or near the front end of the deck panel 30 to keep objects from washing out the stern through the open transom 26 during self-bailing, thus acting like a strainer. The mesh net 48 could also be formed to include a pocket opening upwardly to hold objects.

Skegs 50 and 52 are optionally provided on the underside surface of the bottom panel 12. The skegs 50 and 52 can be affixed by any conventional means, and may include means for detaching and attaching them to the bottom panel 12. The skegs 50 and 52 contribute to directional stability when the watercraft 10 is underway.

The watercraft 10 may optionally include a seat back panel 54 which can be detachably connected to the upper surface 32 of the deck panel 30. The seat back panel 54 can be made of inflatable, drop stitch material for ease of storage and stowage. Detachable coupling means can be provided to provide a pivotal, detachable coupling to the upper surface 32. Straps 56 and 58 can be used to fix the vertical orientation of the seat back panel 54 in a generally vertical orientation to provide back support for a seated user. In an emergency situation, the seat back panel 54 can be detached and thrown in the direction of a person needing rescue, and could be sized and shaped to qualify as a U.S. Coast Guard approved floatation device for rescue purposes. In that case, a line can be include for attaching one end to the watercraft 10 and the other end to the seat back panel 54, for throwing the panel towards a target yet maintaining control of the panel.

Alternatively, a separate chair (not shown) can be positioned approximately where the seat back panel 54 is shown, and having both a seat back portion and a seat portion, and means for holding the chair to the upper surface 32 of the deck panel 30.

Figure 8:
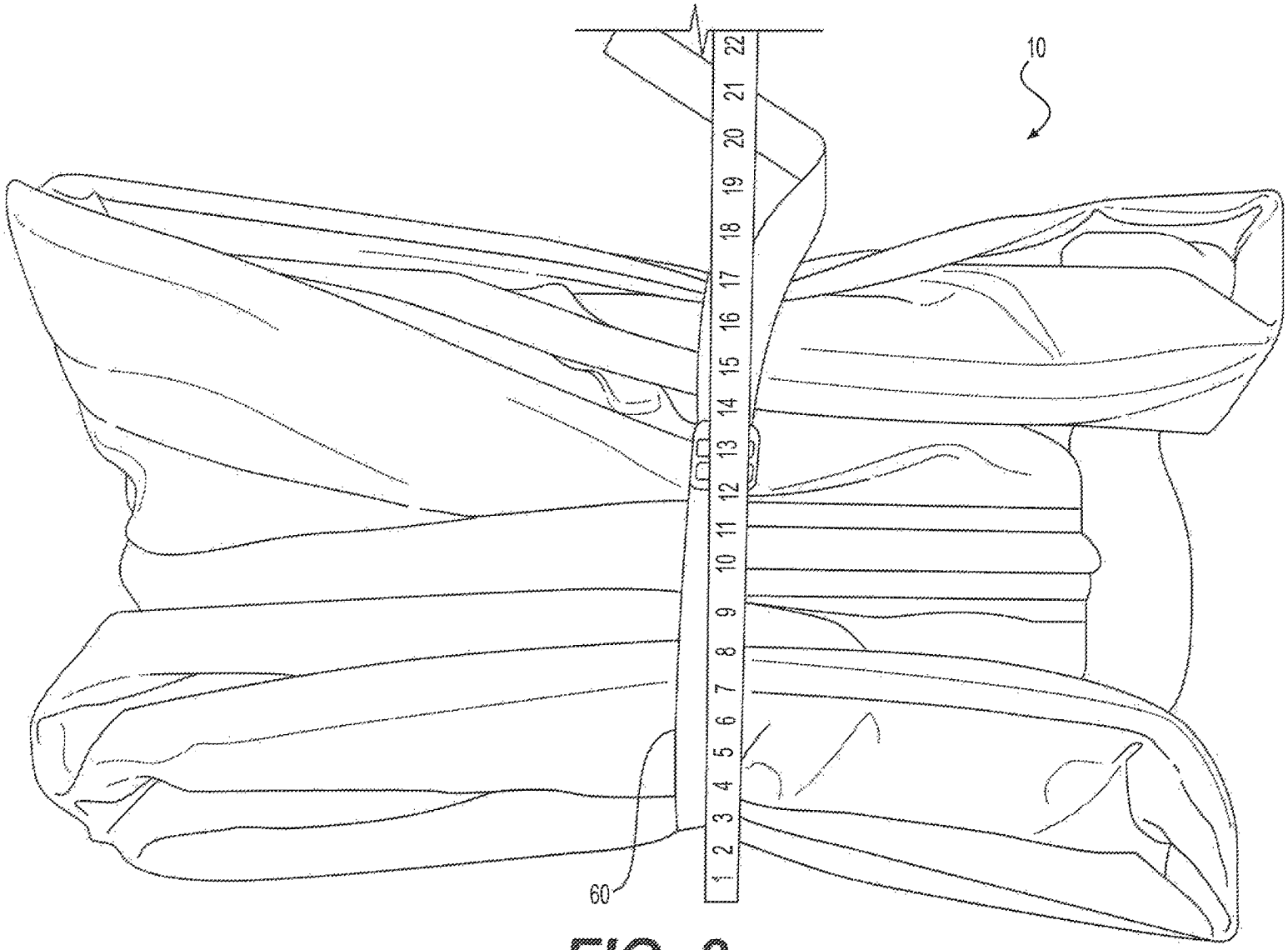
FIG. 8 is a side elevation view of the inflatable watercraft of FIG. 1, in a collapsed, uninflated, folded and stowable disposition, ready for bagging, and showing a tape measure (not part of the invention) to indicate a general width of approximately 18 inches when deflated and folded.
Figure 9:
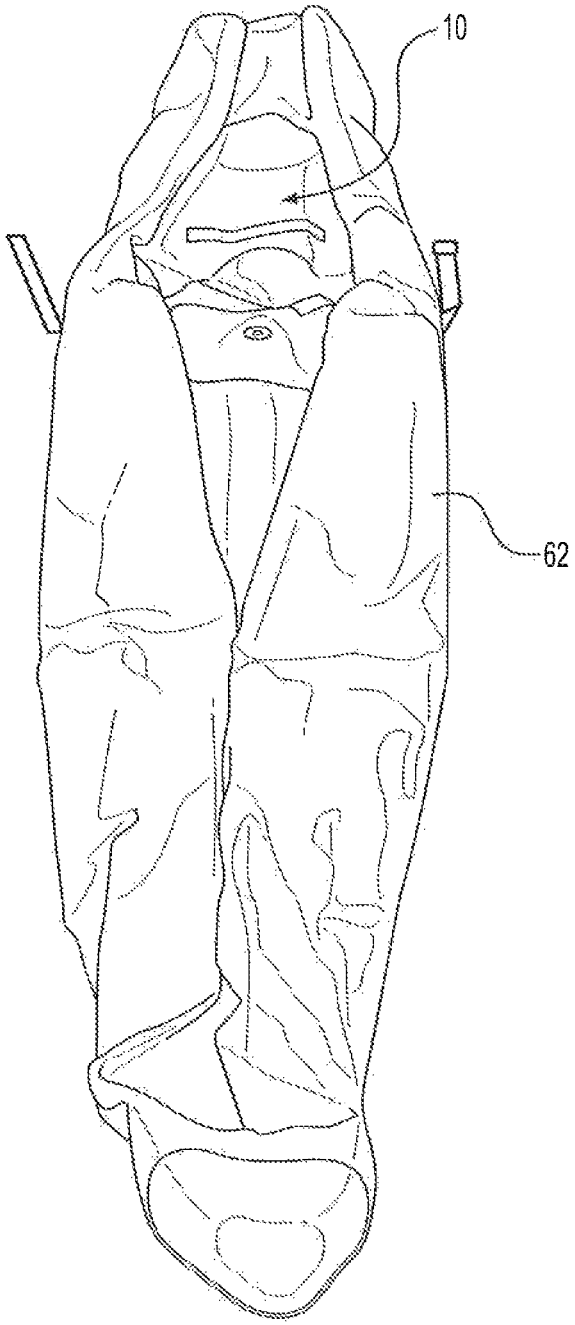
FIG. 9 is a site elevation view of the folded, deflated inflatable watercraft of FIG. 1, stowed in a storage bag.

Referring to FIG. 8, the inflatable watercraft 10 is shown in a deflated, folded disposition, with a pull strap 60 used to draw the folded watercraft 10 into the tightest, smallest possible size. A tape measure, not a part of the invention, is illustrated to show that in one embodiment, the watercraft can be folded into a width of approximately eighteen (18) inches, even though the watercraft may have a weight of approximately 50-55 pounds. In FIG. 9, the watercraft previously folded and illustrated in FIG. 8, is stuffed into a carrying bag or back pack 62 for ease of carry, storage or stowage.

Figure 10:
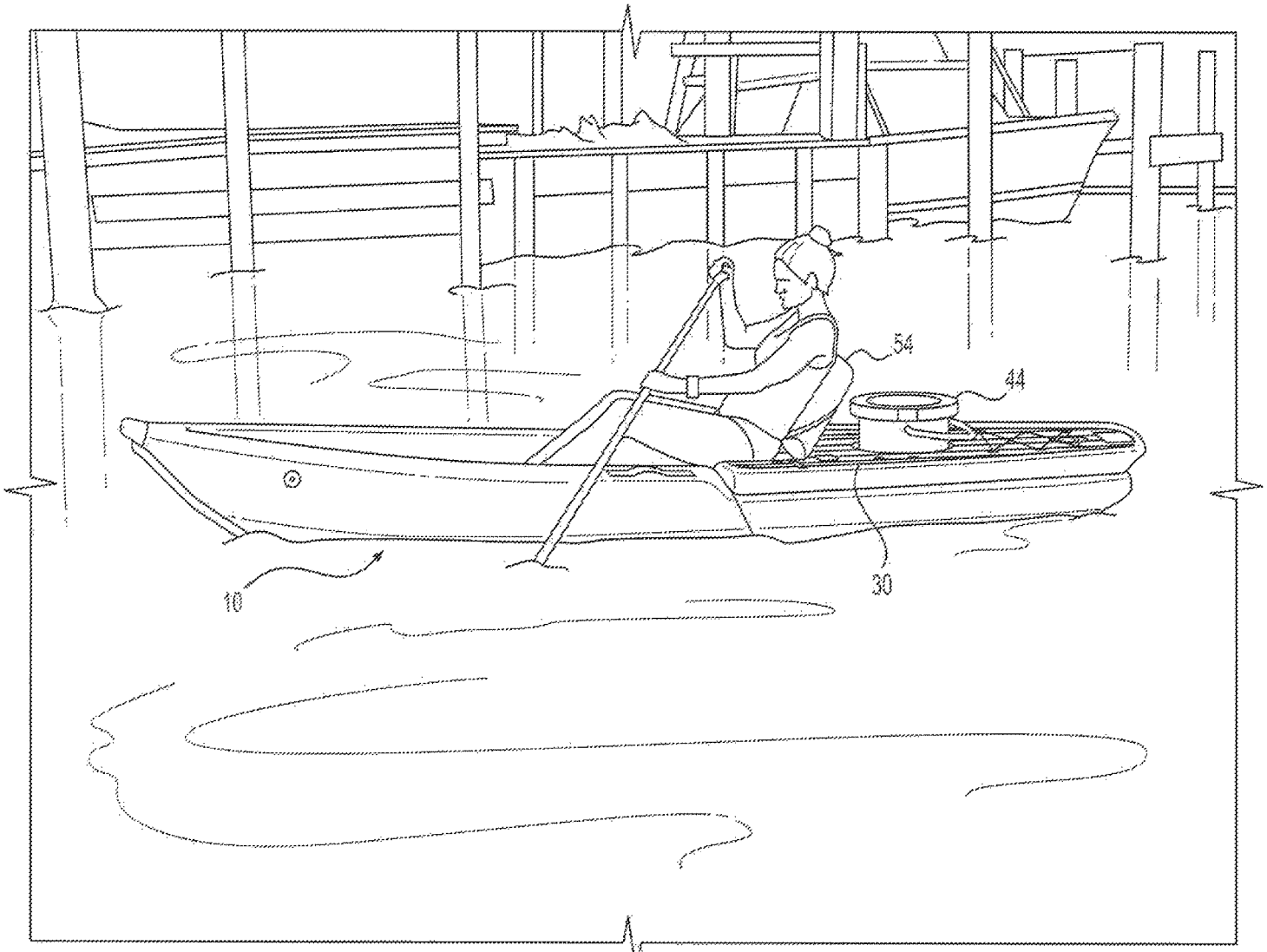
FIG. 10 is a side elevation view showing the inflatable watercraft of FIG. 4, and demonstrating the seating position of a user, and the paddling technique for propulsion.

Operation of the watercraft is shown in FIG. 10, where a user is seated approximately midships on the upper surface of the deck panel 30. The bucket 44 is positioned behind the user and on the centerline of the watercraft for stability. The user braces her back against the seat back panel 54 so that reaction forces from a paddle stroke is resisted by the seat back panel 54, allowing more paddling force to bet used to propel the watercraft either forwardly or rearwardly, or side to side. Preferably the paddle is a canoe type paddle.

Each panel is preferably provided with an inflation valve 72, 74, 76, and 78 to permit inflation of each panel to relatively high pressures. Drop stitch fabric can be made for high pressure fabric, where inflation pressures range from 7-25 p.s.i., or for low pressure fabric, where inflation pressures range between 2 and 7 p.s.i. In the present invention, high pressure fabric is preferred, with a recommended pressure of 15 p.s.i. High pressure material provides the advantages of being stronger and stiffer.

Figure 11:
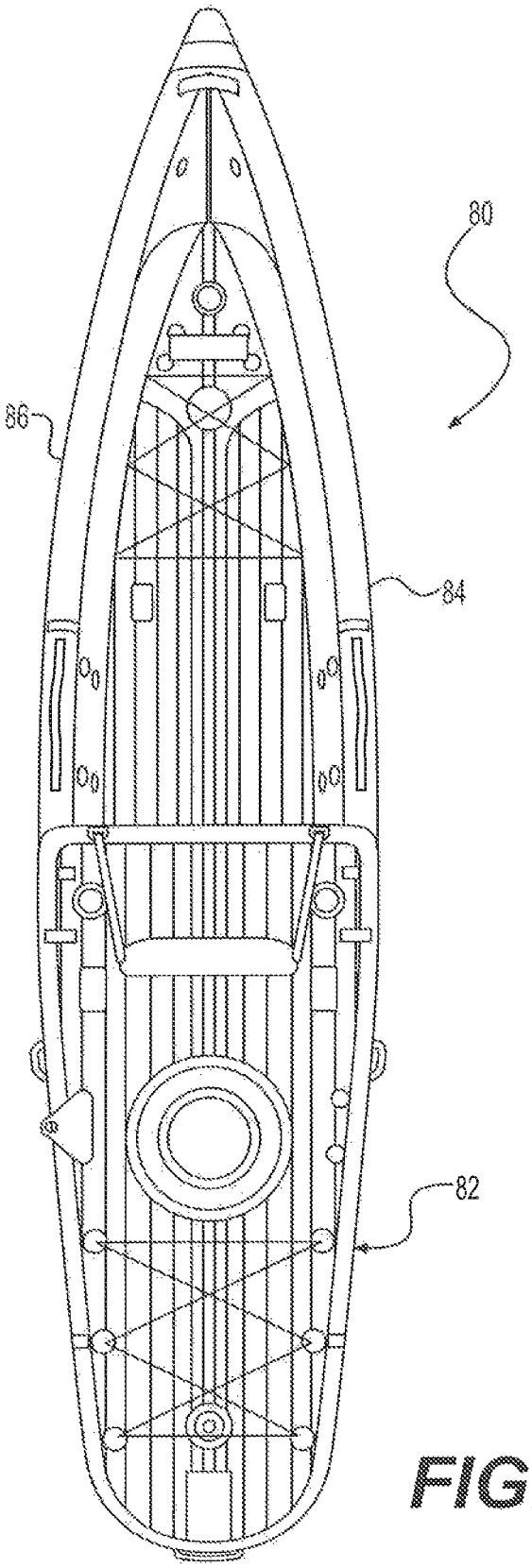
FIG. 11 is a top view of another embodiment of an inflatable watercraft according to the present invention.
Figure 12:
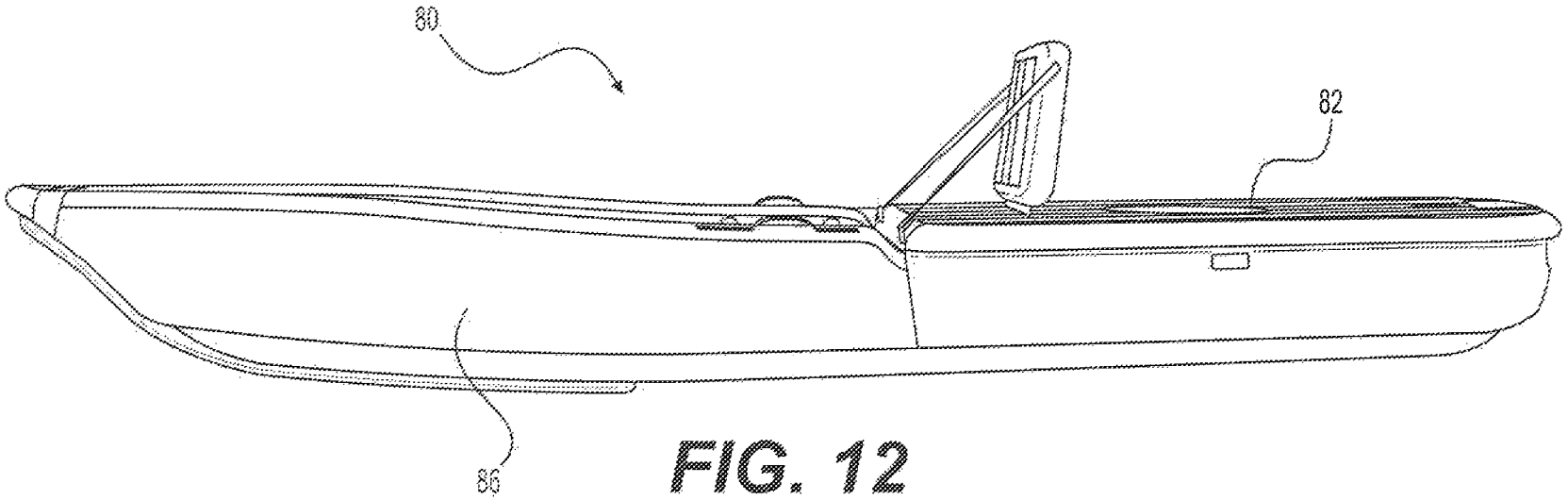
FIG. 12 is a side view of the inflatable watercraft of FIG. 11.
Figure 13:
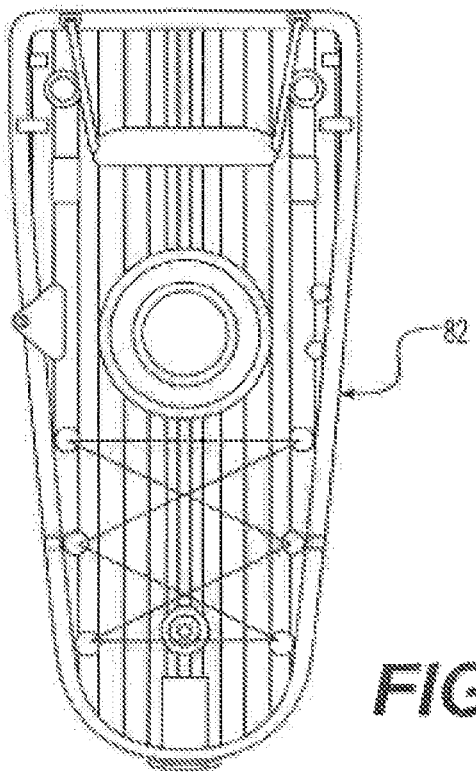
FIG. 13 is a top view of the inflatable watercraft of FIG. 11, with the deck panel removed.

FIGS. 11-13 illustrate an alternative embodiment of an inflatable watercraft 80 having substantially the same structure as the watercraft 10 of FIGS. 1-7, except that the deck panel 82 is detachably connected to the starboard side freeboard panel 84 and the port side freeboard panel 86. The top view of FIG. 11 shows the deck panel 82 in place, with detachable couple means (not shown) used to hold the deck panel 82 firmly in place during use. The detachable coupling means can include straps, buckles, D-rings, and any combination thereof to provide coupling after all panels are inflated. As seen in FIG. 12, the deck panel 82 appears substantially similar to the deck panel 30 of the FIG. 1 embodiment. FIG. 13 shows the watercraft 80 with the deck panel removed, clearly illustrating floor graphics, e.g., parallel lines to resemble a teak and holly sole, and other indications of aquatic tradition.

Figure 14:
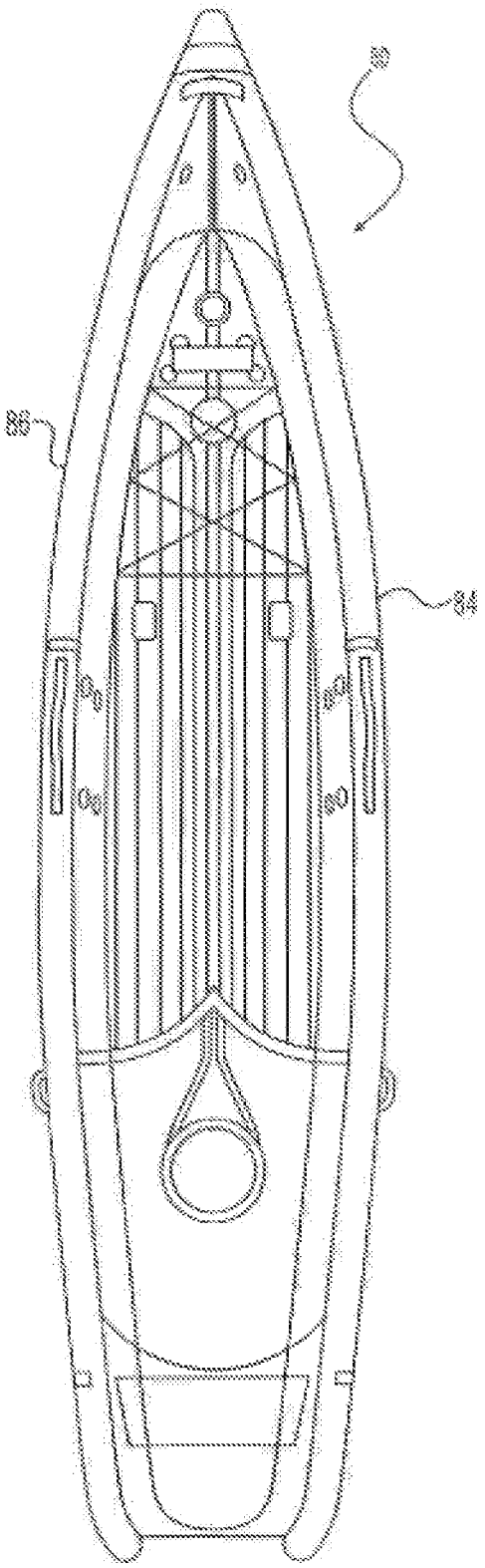
FIG. 14 is an enlarged, sectional view of a drop stitch panel used in accordance to a preferred embodiment of the present invention.
Figure 14:
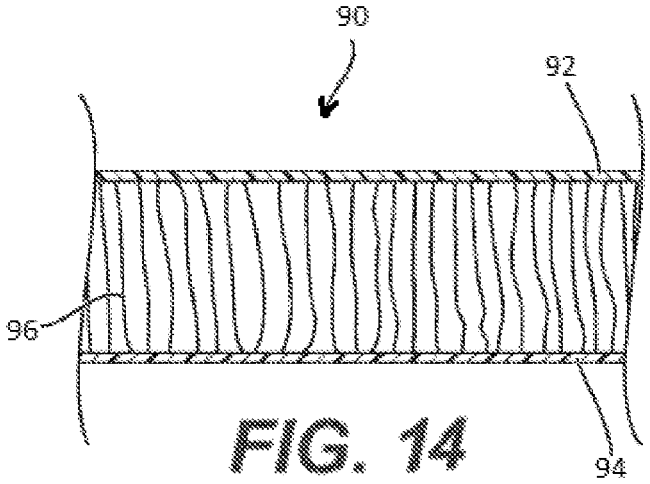

The drop stitch material used to form the various panels described herein are of known construction. Various suppliers make and sell comparable versions of material which, when shaped and assembled as described herein, form unique devices used in aquatic sports. While described in detail in my previous applications, mentioned above and incorporated herein by reference, a basic drop stitch construction is illustrated in FIG. 14, which shows a panel 90 in cross section.

The panel 90 includes two opposing, substantially parallel sheets 92 and 94, between which a plurality of drop stitch yarns or filaments 96 extend. The filaments 96 are typically adhered to a woven fabric which is then laminated, coated or otherwise affixed to a polymeric skin. As schematically shown in FIG. 14, each sheet 92 and 94 could consist of multiple plies of plastic material, such as polyvinyl chloride (PVC). The exact thickness of the sheets 92 and 94 can be selected based on a combination of costs to manufacture and desired strength.

Figure 2:
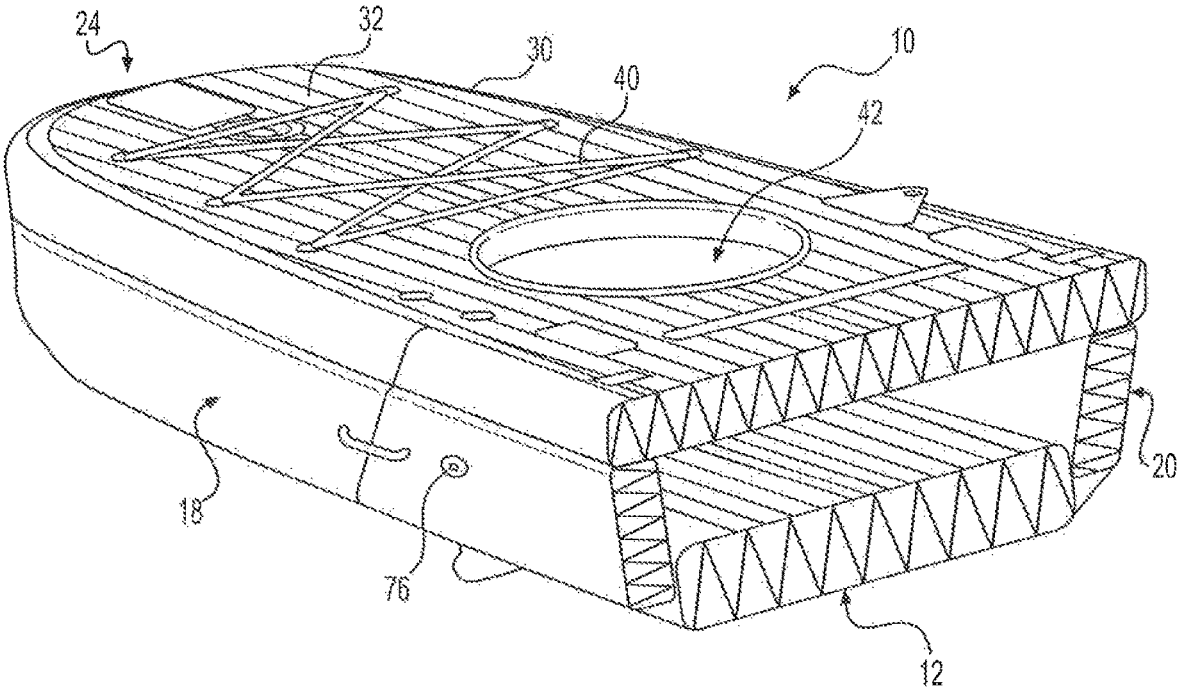
FIG. 2 is a lateral, sectional view taken along line II-II of FIG. 1.
Figure 3:
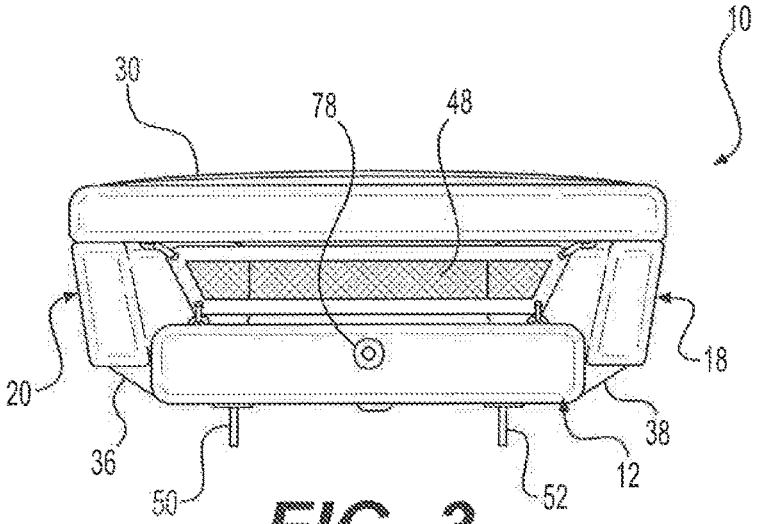
FIG. 3 is a rear view of the inflatable watercraft of FIG. 1.

The cross-sectional view of, for example, FIG. 2, indicate a preferable construction whereby the filaments of the bottom and deck panels are substantially perpendicular to the filaments of the side panels. While the filaments are shown schematically as a saw-tooth pattern of lines extending between the opposite sheets of each panel, the saw-tooth patterns are clearly perpendicular to each other. This arrangement adds to the overall structural integrity of the watercraft.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. An inflatable watercraft comprising:

a bottom panel having a fore end, an aft end, a port side and a starboard side;

a port side freeboard panel having a fore end and an aft end, and being connected to the port side of the bottom panel;

a starboard side freeboard panel having a fore end and an aft end, and being connected to the starboard side of the bottom panel;

the port side freeboard panel and the starboard side freeboard panel converging at their respective fore ends, and terminating substantially parallel to each other at their aft ends to define an open transom and a gunwale; and a deck panel connected to and extending between the port side freeboard panel and the starboard side freeboard panel at an upper edge of the gunwale, and being spaced above the bottom panel.

2. The inflatable watercraft of claim 1, further comprising means for permanently connecting the starboard side freeboard panel and the port side freeboard panel to the bottom panel wherein the connection means is selected from the group consisting of adhesives, stitching and a combination of adhesives and stitching.

3. The inflatable watercraft of claim 1, wherein the open transom extends in height from an upper surface of the bottom panel to a lower surface of the deck panel, and in width from an inner surface of the port side freeboard panel to an inner surface of the starboard side freeboard panel, whereby water entering the watercraft drains by gravity out through the open transom.

4. The inflatable watercraft of claim 1, further comprising means to supplement the connection between abutting panels and overlying an interface between two abutting panels, thereby providing streamlining of outer surfaces and strengthening of interconnections between adjacent panels.

5. The inflatable watercraft of claim 4, wherein the supplement means includes fabric strips bonded to adjacent surfaces of the panels.

6. The inflatable watercraft of claim 1, wherein the deck panel has a length that extends from the transom to approximately a midship position.

7. The inflatable watercraft of claim 1, wherein the deck panel includes means for holding objects to an upper surface of the deck panel.

8. The inflatable watercraft of claim 7, wherein the holding means includes an elastic cord arranged in a zig-zag pattern between a plurality of O-rings adhered to the upper surface of the deck panel.

9. The inflatable watercraft of claim 1, wherein the bottom panel, the starboard side freeboard panel, the port side freeboard panel, and the deck panel are each made of inflatable drop stitch material.

10. The inflatable watercraft of claim 9, wherein the bottom panel, the starboard side freeboard panel, the port side freeboard panel, and the deck panel are each airtight inflatable chambers having an inflation valve, each inflatable chamber being inflatable to a pressure of between 2 and 25 p.s.i.

11. The inflatable watercraft of claim 1, wherein the deck panel includes an opening sized and shaped to receive and hold a container.

12. The inflatable watercraft of claim 1, further comprising a plate disposed at the respective aft ends of the starboard side freeboard panel and the port side freeboard panel, and extending from the gunwale to at least a waterline of the watercraft.

13. The inflatable watercraft of claim 12, wherein the plate is made of light weight, rigid plastic material to which ends of the respective freeboard panels is affixed, and the plate extends from the gunwale down to the waterline, and rearwardly at least partially along the centerline of a keel to contribute to both directional stability and to avoid damage to the keel when maneuvering over rocks or other solid objects.

14. The inflatable watercraft of claim 1, wherein all panels are made of drop stitch material.

15. The inflatable watercraft of claim 14, wherein the starboard side freeboard panel, the port side freeboard panel, the bottom panel, and the deck panel are inflatable to a pressure of about 15 p.s.i.

16. An inflatable watercraft comprising:

a bottom panel having a fore end, an aft end, a port side and a starboard side;

a port side freeboard panel having a fore end and an aft end, and being connected to the port side of the bottom panel; and a starboard side freeboard panel having a fore end and an aft end, and being connected to the starboard side of the bottom panel;

the port side freeboard panel and the starboard side freeboard panel converging at their respective fore ends to define a bow, and terminating substantially parallel to each other at their aft ends to define an open transom;

wherein an upper edge of the port side panel and the starboard side panel define a gunwale.

17. The inflatable watercraft of claim 16, further comprising a deck panel detachably connected to the gunwale and extending between the port side freeboard panel and the starboard side freeboard panel, the deck panel having a length extending between the transom to approximately midships of the watercraft.

18. The inflatable watercraft of claim 17, wherein the deck panel includes an opening sized and shaped to hold a container resting on an upper surface of the bottom panel.

19. The inflatable watercraft of claim 17, further comprising a seat back panel detachably and movably connected to an upper surface of the deck panel.

20. The inflatable watercraft of claim 17, wherein all panels are made of a drop stitch material.

* * * * *